US010861392B2

(12) United States Patent
Yokoyama et al.

(10) Patent No.: US 10,861,392 B2
(45) Date of Patent: Dec. 8, 2020

(54) DISPLAY DEVICE DRIVE METHOD AND DISPLAY DEVICE

(71) Applicant: Sharp Kabushiki Kaisha, Sakai (JP)

(72) Inventors: Makoto Yokoyama, Sakai (JP); Fumiyuki Kobayashi, Sakai (JP); Junichi Yamada, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/494,810

(22) PCT Filed: Mar. 22, 2017

(86) PCT No.: PCT/JP2017/011348
§ 371 (c)(1),
(2) Date: Sep. 17, 2019

(87) PCT Pub. No.: WO2018/173132
PCT Pub. Date: Sep. 27, 2018

(65) Prior Publication Data

US 2020/0098316 A1 Mar. 26, 2020

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/2003* (2013.01); *G09G 3/3266* (2013.01);
(Continued)

(58) Field of Classification Search
CPC .. G09G 3/3241; G09G 3/3275; G09G 3/3291; G09G 2300/0819;
(Continued)

(56) References Cited

U.S. PATENT DOCUMENTS

2007/0118781 A1 5/2007 Kim
2014/0092144 A1 4/2014 Kim et al.
(Continued)

FOREIGN PATENT DOCUMENTS

JP 2007-079580 A 3/2007
JP 2009-271333 A 11/2009
(Continued)

OTHER PUBLICATIONS

Official Communication issued in International Patent Application No. PCT/JP2017/011348, dated Jun. 20, 2017.

*Primary Examiner* — Jennifer T Nguyen
(74) *Attorney, Agent, or Firm* — Keating & Bennett, LLP

(57) ABSTRACT

Provided are a display device drive method and a display device, both of which allow a pixel circuit to be discharged without leaving any electric charge in an OFF sequence for powering off the display device.

During an OFF sequence period, a first node N1 is set to a first ground potential $V_{gnd1}$, which is a potential higher than an initialization potential $V_{ini}$. As a result, even when a second ground potential $V_{gnd2}$ is supplied through a data line $D_j$ to a second conductive terminal of a drive transistor T1, a gate terminal of the drive transistor T1 is not charged with a gate-to-source voltage $V_{gs}$. Therefore, an organic EL display device 1 is powered off with the gate terminal of the drive transistor T1 being charged with the first ground potential $V_{gnd1}$ leaving no electric charge in a pixel circuit 11 after the power off.

9 Claims, 9 Drawing Sheets

(51) Int. Cl.
*G09G 3/20* (2006.01)
*G09G 3/3275* (2016.01)
*G09G 3/3266* (2016.01)

(52) U.S. Cl.
CPC ... *G09G 3/3275* (2013.01); *G09G 2300/0819* (2013.01); *G09G 2300/0842* (2013.01); *G09G 2320/0257* (2013.01); *G09G 2330/027* (2013.01)

(58) Field of Classification Search
CPC ... G09G 2320/0257; G09G 2320/0243; G09G 2330/027; G09G 2310/061; H01L 27/3248; H01L 27/3276
USPC ..... 345/76, 690
See application file for complete search history.

(56) References Cited

U.S. PATENT DOCUMENTS

| | | | | |
|---|---|---|---|---|
| 2016/0063921 | A1* | 3/2016 | Tsai | G09G 3/3233 345/76 |
| 2016/0351124 | A1* | 12/2016 | Kim | G09G 3/3241 |
| 2017/0236470 | A1 | 8/2017 | Miki | |

FOREIGN PATENT DOCUMENTS

| | | | |
|---|---|---|---|
| JP | 2014-071450 | A | 4/2014 |
| WO | 2016/059756 | A1 | 4/2016 |

* cited by examiner

DISPLAY DEVICE DRIVE METHOD AND DISPLAY DEVICE

TECHNICAL FIELD

The present invention relates to display device drive methods, more specifically to a display device, such as an organic EL display device, which includes electro-optical elements driven by current, and a method for driving the same.

BACKGROUND ART

In recent years, organic EL (electroluminescent) display devices have been drawing attention and actively developed as thin display devices that achieve high image quality and low power consumption. In such an organic EL display device, pixel circuits, including organic EL elements, which are self-illuminating display elements driven by current, drive transistors, etc., are disposed in a matrix.

In Patent Document 1, a logic power supply voltage continues to be outputted for a power-off delay period in an OFF sequence initiated at the time when an organic EL display device is powered off, whereby a panel driver circuit, which is driven by the logic power supply voltage, is used to supply each pixel with preset black display data. Thus, it is possible to release electric charge remaining in the pixel, thereby erasing an afterimage appearing at the time of power off or an afterimage appearing on a display panel rebooted by turning power back on after power off.

CITATION LIST

Patent Document

Patent Document 1: Japanese Laid-Open Patent Publication No. 2014-71450

SUMMARY OF THE INVENTION

Problems to be Solved by the Invention

However, the pixel circuit of the organic EL display device described in Patent Document 1 does not include a data compensation circuit as provided in organic EL display devices to be described later in embodiments of the present invention in order to compensate for threshold voltage variations of drive transistors by means of diode connection. Accordingly, even when a drive method described in Patent Document 1 is applied to a pixel circuit with a diode-connected data compensation circuit, some electric charge remains in the pixel circuit at the time of power off, resulting in deterioration of transistors included in the pixel circuit or an afterimage appearing when another image is displayed on a display panel by turning the power back on after the power off.

Therefore, an objective of the present invention is to provide a display device drive method and a display device, both of which allow pixel circuits to be discharged without leaving electric charge in an OFF sequence performed for power off.

Solution to the Problems

A first aspect of the present invention is directed to a method for driving an active-matrix display device for displaying an image by causing electro-optical elements to emit light, the display device including:

a plurality of data lines to be supplied with data signals for displaying the image;

a plurality of scanning lines disposed so as to cross the data lines;

a plurality of pixel circuits provided at intersections of the data lines and the scanning lines;

a data line driver circuit configured to supply the data signals respectively to the data lines; and a scanning line driver circuit configured to sequentially select and thereby activate the scanning lines at times when the data signals are supplied to the data lines corresponding to the scanning lines, the pixel circuit includes:

the electro-optical element;

a drive transistor configured to control a current flowing in the electro-optical element and having a control terminal and a first conductive terminal electrically connected when the scanning line corresponding to the pixel circuit is activated;

a first node connected to the control terminal;

a second node connected to a second conductive terminal of the drive transistor;

a data compensation circuit configured to compensate for changes of a threshold voltage of the drive transistor and hold a voltage between the control terminal and the first conductive terminal; and an initialization circuit configured to initialize a potential on the first node, and an OFF sequence involved in powering off the display device includes:

an initialization step for writing a first ground potential to the first node at some point during a period after the power off, in which a black display potential corresponding to black display data is supplied to the data lines, the first ground potential initializing the potential on the first node; and a writing step for, when the corresponding scanning line is activated, writing a second ground potential to the second node through the data line so as not to electrically connect the control terminal and the first conductive terminal.

According to a second aspect of the present invention, in the first aspect of the present invention, transistors included in the pixel circuit are P-channel transistors, and the second ground potential is less than or equal to a potential obtained by adding the threshold voltage of the drive transistor to the first ground potential.

According to a third aspect of the present invention, in the first aspect of the present invention, transistors included in the pixel circuit are N-channel transistors, and the second ground potential is greater than or equal to a potential obtained by subtracting the threshold voltage of the drive transistor from the first ground potential.

According to a fourth aspect of the present invention, in the first aspect of the present invention, the initialization circuit includes an initialization line for supplying the first ground potential and an initialization transistor configured to electrically connect the initialization line and the first node, and the initialization step includes:

supplying the first ground potential to the initialization line after the power off;

rendering the initialization transistor conductive in accordance with an active preceding scanning signal outputted by the scanning line driver circuit; and writing the first ground potential from the initialization line to the first node via the initialization transistor.

According to a fifth aspect of the present invention, in the first aspect of the present invention, the display device further includes a power supply configured to supply a power supply voltage to the electro-optical element, and in the initialization step, the first ground potential is written to the first node at a time when the power supply voltage is stopped from being supplied to the electro-optical element.

According to a sixth aspect of the present invention, in the first aspect of the present invention, the display device further includes a writing transistor configured to electrically connect the data line and the second node, and the writing step includes:

supplying the second ground potential to the data line;

rendering the writing transistor conductive in accordance with a current scanning signal activating the corresponding scanning line; and writing the second ground potential supplied to the data line to the second node.

According to a seventh aspect of the present invention, in the sixth aspect of the present invention, the data compensation circuit includes:

a compensation transistor configured to electrically connect the first conductive terminal and the control terminal of the drive transistor in accordance with a scanning signal provided by the scanning line driver circuit; and a capacitive element configured to hold a voltage between the first conductive terminal and the control terminal, the pixel circuit includes a third node connected to the first conductive terminal of the drive transistor, and the writing step further includes:

rendering the compensation transistor conductive in accordance with the current scanning signal; and writing the second ground potential written to the first node to the third node via the conductive compensation transistor.

According to an eighth aspect of the present invention, in the first aspect of the present invention, the display device further includes a plurality of select/output circuits configured to select color data signals from among a plurality of color data signals for displaying color images and supply the selected color data signals respectively to the data lines, the plurality of color data signals being included in data signals that are supplied from the data line driver circuit and correspond to a plurality of primary colors, the pixel circuits include a plurality of subpixel circuits configured to cause the electro-optical elements to emit light in accordance with the color data signals, the initialization step includes simultaneously writing the first ground potential supplied through the initialization line to the first nodes of the subpixel circuits, the writing step includes:

writing the second ground potential sequentially to the data lines, the second ground potential corresponding to each of the primary colors selected by the select/output circuits; and rendering the writing transistor conductive in accordance with a current scanning signal outputted by the scanning line driver circuit, thereby writing the second ground potential simultaneously to the second nodes of the subpixel circuits through the data lines.

A ninth aspect of the present invention is directed to an active-matrix display device for displaying an image by causing electro-optical elements to emit light, the display device including:

a plurality of data lines to be supplied with data signals for displaying the image;

a plurality of scanning lines disposed so as to cross the data lines;

a plurality of pixel circuits provided at intersections of the data lines and the scanning lines;

a data line driver circuit configured to supply the data signals respectively to the data lines; and a scanning line driver circuit configured to sequentially select and thereby activate the scanning lines at times when the data signals are supplied to the data lines corresponding to the scanning lines, the pixel circuit includes:

the electro-optical element;

a drive transistor configured to control a current flowing in the electro-optical element and having a control terminal and a first conductive terminal electrically connected when the scanning line corresponding to the pixel circuit is active;

a first node connected to the control terminal;

a second node connected to a second conductive terminal of the drive transistor;

a data compensation circuit configured to compensate for changes of a threshold voltage of the drive transistor and hold a voltage between the control terminal and the first conductive terminal; and an initialization circuit configured to initialize a potential on the first node, when the display device is powered off, the initialization circuit writes a first ground potential to the first node at some point during a period in which a black display potential corresponding to black display data is supplied to the data lines, the first ground potential initializing the potential on the first node, and when the corresponding scanning line is activated, the data compensation circuit writes a second ground potential to the second node through the data line so as not to electrically connect the control terminal and the first conductive terminal.

Effect of the Invention

In the first aspect, during an OFF sequence period in which the display device is powered off, the first node is set to the first ground potential. As a result, even when the second ground potential is supplied from the data line to the second conductive terminal of the drive transistor, the gate terminal of the drive transistor is not charged with a gate-to-source voltage. Accordingly, the display device is powered off with the gate terminal of the drive transistor being charged with the first ground potential. Therefore, since any electric charge in the pixel circuit is released and no electric charge remains in the pixel circuit at the end of the OFF sequence period, transistors included in the pixel circuit are kept from deteriorating, and no afterimage appears when another image is displayed by turning the power back on after the power off.

In the second aspect, since the transistors included in the pixel circuit are P-channel transistors and the second ground potential is less than or equal to a potential obtained by adding the threshold voltage of the drive transistor to the first ground potential, even when the second ground potential is supplied from the data line to the second conductive terminal of the drive transistor, the gate terminal of the drive transistor is not charged with the gate-to-source voltage. Thus, effects similar to those achieved by the first aspect can be achieved.

In the third aspect, since the transistors included in the pixel circuit are N-channel transistors and the second ground potential is greater than or equal to a potential obtained by subtracting the threshold voltage of the drive transistor from the first ground potential, even when the second ground potential is supplied from the data line to the second conductive terminal of the drive transistor, the gate terminal of the drive transistor is not charged with the gate-to-source voltage. Thus, effects similar to those achieved by the first aspect can be achieved.

In the fourth aspect, the potential with which to charge the initialization line is changed from the initialization potential to the first ground potential, and the first ground potential is written to the first node. Thus, the potential on the first node can be readily changed to the first ground potential, with the result that no electric charge remains in the pixel circuit after the OFF sequence period.

In the fifth aspect, the first ground potential is written to the first node at the time when the power supply voltage is stopped from being supplied to the electro-optical element, and therefore, the first node can be efficiently initialized.

In the sixth aspect, the drive transistor is in OFF state because of the first ground potential written to the first node. In this case, by rendering the writing transistor in ON state, the second ground potential is written from the data line to the second node connected to the second conductive terminal of the drive transistor and the second conductive terminal of the writing transistor. Thus, the drive transistor can more reliably be maintained in OFF state, with the result that no electric charge remains in the pixel circuit after the OFF sequence period.

In the seventh aspect, the drive transistor is in OFF state because of the first ground potential written to the first node. Accordingly, by rendering the compensation transistor in ON state, the first ground potential written to the first node is also written to the third node connected to the first conductive terminal of the drive transistor and the first conductive terminal of the compensation transistor. Thus, the drive transistor can more reliably be maintained in OFF state, with the result that no electric charge remains in the pixel circuit after the OFF sequence period.

In the eighth aspect, the display device includes the select/output circuits that select color data signals from among a plurality of color data signals for displaying color images and supply the selected color data signals respectively to the data lines, the plurality of color data signals being included in data signals that correspond to a plurality of primary colors; during the OFF sequence period in which the display device is powered off, initially, first nodes of all subpixel circuits are simultaneously set to the first ground potential. Next, the second ground potential is supplied from the data line sequentially to the second conductive terminals of the drive transistors for respective subpixel circuits. In this case, as in the first aspect, the gate terminals of the drive transistors are not charged with the gate-to-source voltage, and therefore, the display device is powered off with the gate terminals of the drive transistors being charged with the first ground potential. Thus, any electric charge in each subpixel circuit is released and no electric charge remains in the subpixel circuit at the end of the OFF sequence period, whereby the transistors included in the subpixel circuit are kept from deteriorating, and no afterimage appears when another image is displayed by turning the power back on after the power off.

The ninth aspect renders it possible to achieve effects similar to those achieved by the first aspect.

MODES FOR CARRYING OUT THE INVENTION

1. Basic Study

Before describing an organic EL display device according to the present embodiment, an organic EL display device in which data compensation circuits in pixel circuits are diode-connected circuits will be described with respect to the principle of transistor deterioration and afterimage appearance due to electric charge remaining in the pixel circuits in the course of an OFF sequence. Note that unless otherwise specified, transistors will be described herein as being of P-channel type, but the transistors are not limited to P-channel type and may be of N-channel type. Moreover, in the present embodiment, the transistors are, but are not limited to, for example, thin-film transistors (TFTs). The P-channel transistor is rendered in ON state when a low-level potential is supplied at a gate terminal, and in OFF state when a high-level potential is supplied.

1.1 Configuration of the Pixel Circuit

Figure 1:
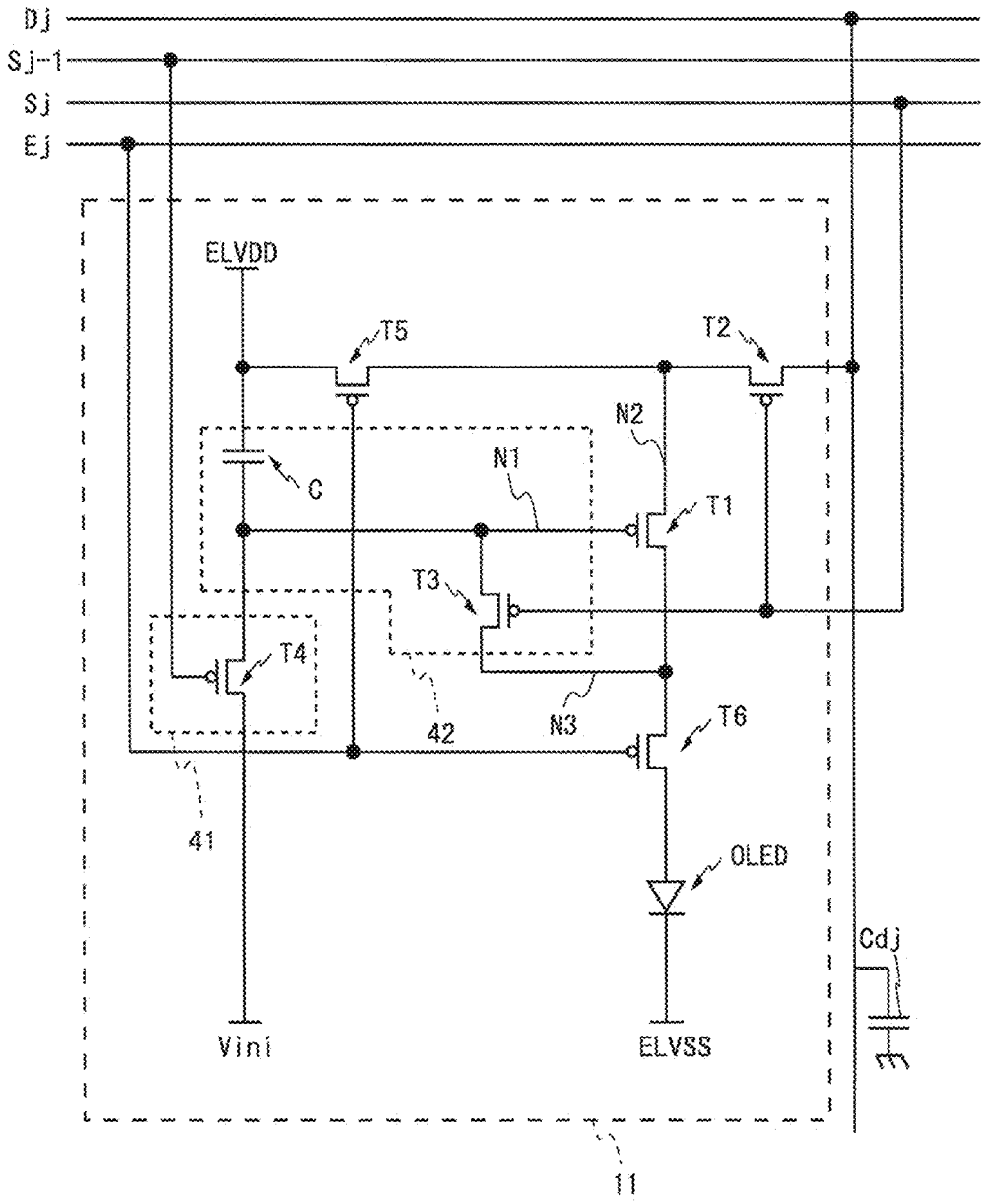
FIG. 1 is a circuit diagram illustrating the configuration of a pixel circuit including a diode-connected data compensation circuit.

FIG. 1 is a circuit diagram illustrating the configuration of a pixel circuit 11 including a diode-connected data compensation circuit 42. Referring to FIG. 1, the pixel circuit 11 includes one organic EL element OLED (also referred to as an "electro-optical element"), six transistors T1 to T6, and one capacitor C. More specifically, included in the pixel circuit 11 are an organic EL element OLED, a drive transistor T1, a writing transistor T2, a compensation transistor T3, an initialization transistor T4, a power supply transistor T5, an emission control transistor T6, and a capacitor C serving as a capacitive element.

The drive transistor T1 has a gate terminal (also referred to as a "control terminal"), a first conductive terminal, and a second conductive terminal; the first conductive terminal is connected to a third node N3, and the second conductive terminal is connected to a second node N2. In the case of the drive transistor T1, the first conductive terminal and the second conductive terminal respectively serve as a drain terminal and a source terminal, or vice versa, depending on carrier flow. For example, a data voltage supplied from a data line $D_j$ is provided through the writing transistor T2, the drive transistor T1, and the compensation transistor T3 to the gate terminal of the drive transistor T1. In this case, the first conductive terminal of the drive transistor T1 serves as a drain terminal, and the second conductive terminal serves as a source terminal.

The pixel circuit 11 is connected to a scanning line $S_j$(also referred to as a "current scanning line"), a scanning line $S_{j-1}$ (also referred to as a "preceding scanning line") immediately preceding the current scanning line $S_j$, an emission line $E_j$, the data line $D_j$, a high-level power line ELVDD, a low-level power line ELVSS, and an initialization line $V_{ini}$. Note that the high-level power line ELVDD is a power line for supplying a high-level potential ELVDD, the low-level power line ELVSS is a power line for supplying a low-level potential ELVSS, and the initialization line $V_{ini}$ is a power line for supplying an initialization potential $V_{ini}$.

In the pixel circuit 11, the writing transistor T2 has a gate terminal connected to the current scanning line $S_j$, a first conductive terminal connected to the data line $D_j$ as a source terminal, and a second conductive terminal connected to the second node N2 as a drain terminal. The writing transistor T2 writes a data voltage with which the data line $D_j$ is being charged, to the pixel circuit 11 in response to the current scanning line $S_j$ being selected.

The source terminal, which is the second conductive terminal of the drive transistor T1, is connected by the second node N2 to the drain terminal, which is the second conductive terminal of the writing transistor T2. The drive transistor T1 supplies the organic EL element OLED with a drive current I in accordance with a gate-to-source voltage $V_{gs}$ via the emission control transistor T6 to be described later.

The compensation transistor T3 is provided between the gate terminal and the first conductive terminal of the drive transistor T1, and has a first conductive terminal connected by the third node N3 to the first conductive terminal of the drive transistor T1. In the pixel circuit 11, the compensation transistor T3 has a gate terminal connected to the current scanning line $S_j$. When the compensation transistor T3 is rendered in ON state in response to the current scanning line $S_j$ being selected, the compensation transistor T3 diode-connects the drive transistor T1 by connecting the gate terminal and the first conductive terminal of the drive transistor T1.

The initialization transistor T4 is provided between the gate terminal of the drive transistor T1 and the initialization line $V_{ini}$ and has a gate terminal connected to the preceding scanning line $S_j$I. When the initialization transistor T4 is rendered in ON state in response to the preceding scanning line $S_{j-1}$ being selected, a potential on a first node N1, which connects a drain terminal of the initialization transistor T4 and the gate terminal of the drive transistor T1, is set to the initialization potential $V_{ini}$. As a result, the initialization potential $V_{ini}$ is supplied to the gate terminal of the drive transistor T1.

The power supply transistor T5 is provided between the high-level power line ELVDD and the first conductive terminal of the drive transistor T1, and has a gate terminal connected to the emission line $E_j$ When the power supply transistor T5 is rendered in ON state in response to the emission line $E_j$ being selected, the drive transistor T1 is supplied with the high-level potential ELVDD at the second conductive terminal.

The emission control transistor T6 is provided between the drive transistor T1 and the organic EL element OLED, and has a gate terminal connected to the emission line $E_j$. When the emission control transistor T6 is rendered in ON state in response to the emission line $E_j$ being selected, the emission control transistor T6 supplies the drive current I to the organic EL element OLED.

The capacitor C has a first terminal connected to the gate terminal of the drive transistor T1 and a second terminal connected to the high-level power line ELVDD. The capacitor C holds a gate voltage $V_g$ of the drive transistor T1 when the current scanning line $S_j$ connected to the pixel circuit 11, including the capacitor C, is deselected, whereby the compensation transistor T3 is rendered in OFF state.

The organic EL element OLED has an anode (a terminal of the organic EL element OLED) connected to a second conductive terminal of the emission control transistor T6 and a cathode (the other terminal of the organic EL element OLED) connected to the low-level power line ELVSS. The organic EL element OLED emits light with a luminance in accordance with the drive current I supplied by the drive transistor T1.

1.2 Method for Driving the Pixel Circuit

Figure 2:
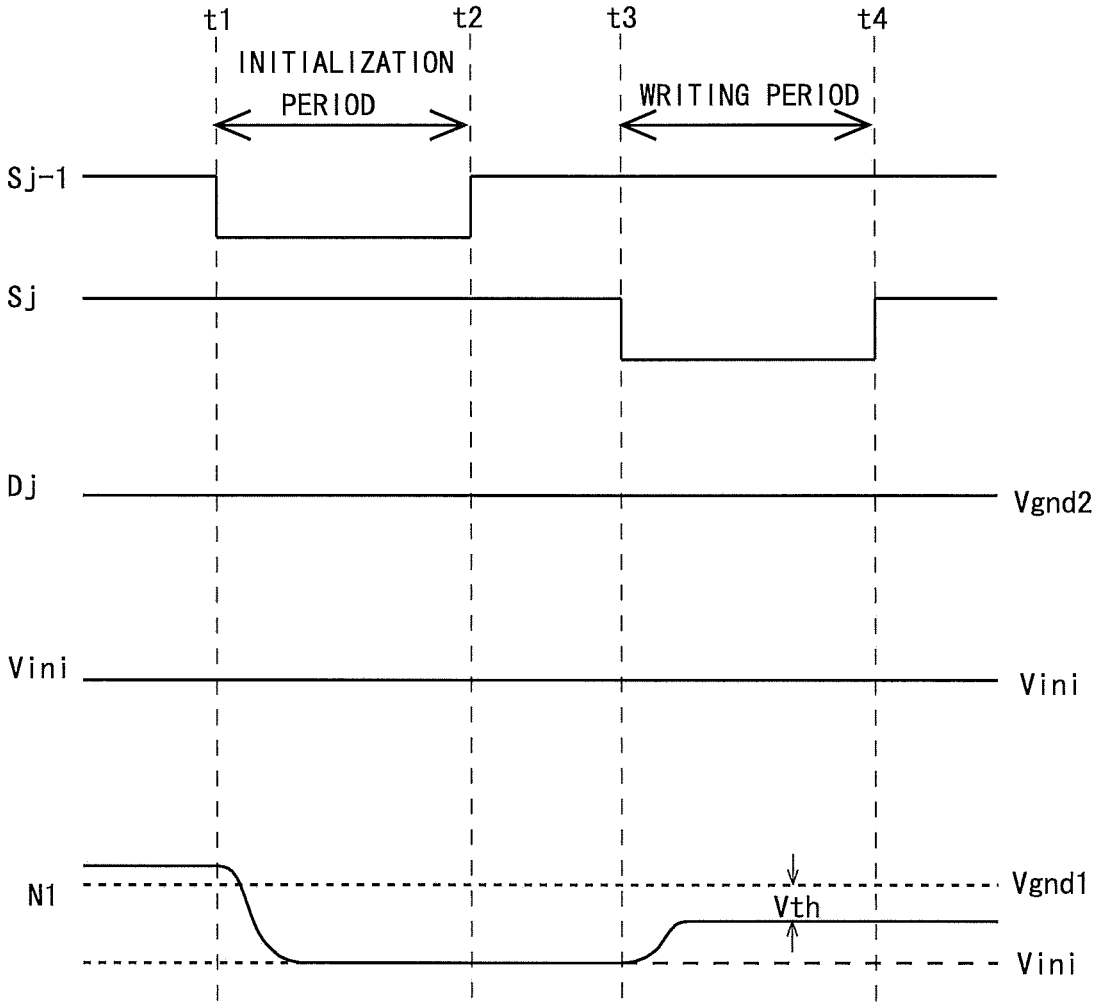
FIG. 2 is a timing chart describing a method for driving the pixel circuit shown in FIG. 1 during an OFF sequence period in a basic study.

FIG. 2 is a timing chart describing a method for driving the pixel circuit 11 shown in FIG. 1 during an OFF sequence period. As shown in FIG. 2, the OFF sequence period is divided into: an initialization period during which the initialization potential $V_{ini}$ is provided to the first node N1 connected to the gate terminal of the drive transistor T1, thereby initializing the first node N1; and a writing period following the initialization of the first node N1, during which a ground potential $V_{gnd}$ is written to the first node N1, the second node N2, and the third node N3 through the data line $D_j$. Note that the OFF sequence period refers to a processing period from reception of a power-off command from a power switch, an external operating means, or the like, until transition to a power-off state, which occurs after each unit in the display device is set in a predetermined state.

First, the initialization period will be described. At time t1, the preceding scanning line $S_{j-1}$ experiences a change in potential from high level to low level. As a result, a low-level voltage is supplied to the gate terminal of the initialization transistor T4, whereby the initialization transistor T4 is rendered in ON state. Accordingly, the initialization potential $V_{ini}$, which is lower than the ground potential $V_{gnd}$, is supplied to the first node N1 from the initialization line $V_{ini}$ through the initialization transistor T4, whereby the first node N1 is charged with the initialization potential $V_{ini}$. At time t2, the preceding scanning line $S_{j-1}$ experiences a change in potential from low level to high level, whereby the initialization transistor T4 is rendered in OFF state. In this manner, an initialization circuit 41, including the initialization transistor 14, is operated during the initialization period. In this case, since the potential on the current scanning line $S_j$ is high-level, the data compensation circuit 42, including the compensation transistor T3 and the capacitor C, is not operated, and the data line $D_j$ is set at the ground potential $V_{gnd}$.

Next, the writing period will be described. At time t3, the current scanning line $S_j$ experiences a change in potential from high level to low level. As a result, the writing transistor T2 and the compensation transistor T3 are rendered in ON state. Moreover, the data line $D_j$ is set at the ground potential $V_{gnd}$. Accordingly, the ground potential $V_{gnd}$ on the data line $D_j$ is written to the first node N1 via the writing transistor T2, the drive transistor T1, and the compensation transistor T3. In this case, the gate-to-source voltage $V_{gs}$ on the drive transistor T1 is lower than the ground potential $V_{gnd}$ on the source terminal by a threshold voltage $V_{th}$ of the drive transistor T1. Accordingly, the potential on the first node N1 connected to the gate terminal of the drive transistor T1 does not rise from the initialization potential $V_{ini}$ to as high as the ground potential $V_{gnd}$, but only to a potential lower than the ground potential $V_{gnd}$ by the threshold voltage $V_{th}$.

As a result, electric charge held in the capacitor C is not completely released, so that the organic EL display device is powered off, leaving some electric charge unreleased. In this case, the ground potential $V_{gnd}$ provided through the data line $D_j$ is written to the second node N2, which connects the second conductive terminal of the drive transistor T1 and the second conductive terminal of the writing transistor T2, and also written to the third node N3, which connects the first conductive terminal of the drive transistor T1 and the first conductive terminal of the compensation transistor T3. Accordingly, when the organic EL display device is powered off, the electric charge remaining in the capacitor C is left unreleased and might cause deterioration of the drive transistor T1 and/or an afterimage appearing on a display part 10 when the power is turned back on.

In this manner, the potential on the first node N1 connected to the gate terminal of the drive transistor T1 is initialized to the initialization potential $V_{ini}$ by the initialization circuit 41 during the initialization period. Thereafter, the data compensation circuit 42 performs potential compensation, and therefore, even when an attempt is made to write the ground potential $V_{gnd}$, with which the data line $D_j$ is being charged, to the first node N1 in order to set the potential on the first node N1 to the ground potential $V_{gnd}$, the potential on the first node N1 only rises to a value lower than the ground potential $V_{gnd}$ by the threshold voltage $V_{th}$. Therefore, there is a problem in that the capacitor C holds an electric charge corresponding to the threshold voltage $V_{th}$, and the charge is left unreleased even after the OFF sequence period.

Therefore, embodiments will be described below with reference to drive methods which keep any electric charge from remaining in the first node N1 after the OFF sequence period.

2. First Embodiment

Hereinafter, a first embodiment of the present invention will be described with reference to the accompanying drawings.

2.1 General Configuration

Figure 3:
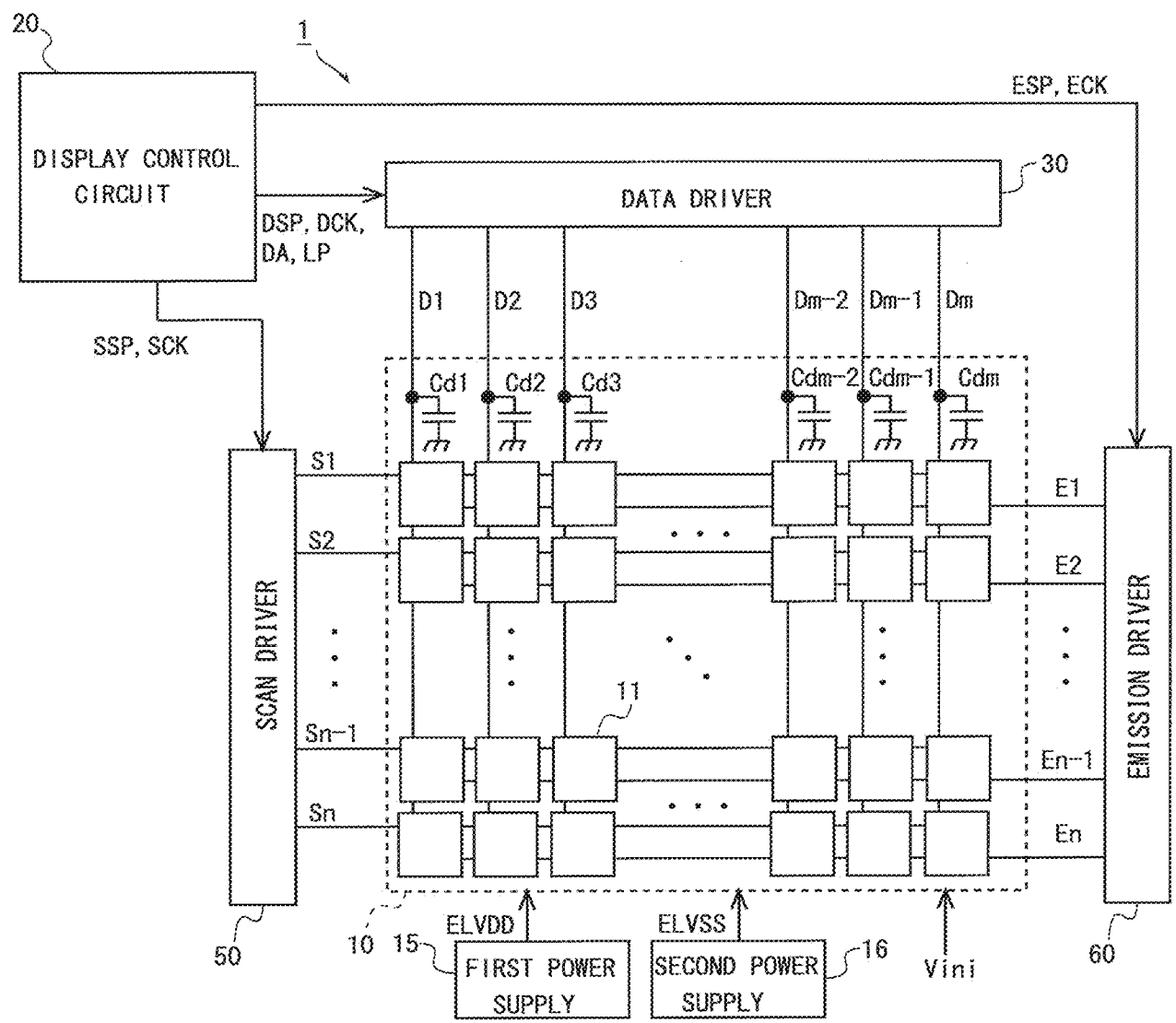
FIG. 3 is a block diagram illustrating the general configuration of an organic EL display device according to a first embodiment.

FIG. 3 is a block diagram illustrating the general configuration of an organic EL display device 1 according to the first embodiment of the present invention. The organic EL display device 1 according to the present embodiment is generally a display device capable of color display in the three primary colors, R, G, and B, but in the present embodiment, for the sake of simplicity, the organic EL display device 1 is assumed to be a display device for displaying any one of the colors. Accordingly, the organic EL display device 1 includes no demultiplexers.

The organic EL display device 1 is an active-matrix display device including a display part 10, a display control circuit 20, a data driver 30, a scan driver 50, and an emission driver 60, as shown in FIG. 3. Since the organic EL display device 1 includes no demultiplexers, the data driver 30 supplies a data signal to each data line $D_j$. Note that in the present embodiment, the data driver 30 realizes a data line driver circuit, the scan driver 50 realizes a scanning line driver circuit, and the emission driver 60 realizes a control line driver circuit. Moreover, the scan driver 50 and the emission driver 60 may be integrally formed with or separately formed from, for example, the display part 10.

The display part 10 has provided therein m (where m is an integer of 2 or more) data lines $D_1$ to $D_m$ and n scanning lines $S_1$ to $S_n$ crossing the data lines. The display part 10 has also provided therein (m×n) pixel circuits 11 corresponding to intersections of the data lines $D_1$ to $D_m$ and the scanning lines $S_1$ to $S_n$. The display part 10 has n emission lines $E_1$ to $E_n$ provided parallel to the n scanning lines $S_1$ to $S_n$ and serving as control lines. The m data lines $D_1$ to $D_m$ are connected to the data driver 30, and the n scanning lines $S_1$ to $S_n$ are connected to the scan driver 50. The n emission lines $E_1$ to $E_n$ are connected to the emission driver 60.

The display part 10 has power lines provided in common to the pixel circuits 11. More specifically, provided is a power line for supplying a high-level potential ELVDD for driving organic EL elements to be described later, and also a power line for supplying a low-level potential ELVSS for driving the organic EL elements. There is also provided an initialization line $Vi_{ini}$ for supplying an initialization potential $V_{ini}$ for an initialization operation to be described later. These potentials are respectively supplied by a first power supply 15 and a second power supply 16. In the present embodiment, the high-level power line ELVDD supplies the high-level potential ELVDD, and the low-level power line ELVSS supplies the low-level potential ELVSS.

Furthermore, there are m data capacitors $C_{d1}$ to $C_{dm}$ respectively connected at one terminal to the m data lines $D_1$ to $D_m$ and grounded at the other terminal (not connected to the data lines $D_j$) so as to hold the data signals provided to the data lines $D_j$.

The display control circuit 20 outputs various control signals to the data driver 30, the scan driver 50, and the emission driver 60. More specifically, the display control circuit 20 outputs a data start pulse DSP, a data clock DCK, display data DA, and a latch pulse LP to the data driver 30. Moreover, the display control circuit 20 outputs a gate start pulse SSP and a gate clock SCK to the scan driver 50 and an emission start pulse EMSP and an emission clock EMCK to the emission driver 60.

The data driver 30 includes unillustrated elements such as an m-bit shift register, a sampling circuit, a latch circuit, and m D/A converters. The shift register has m bistable circuits cascaded to each other, and transfers the data start pulse DSP supplied to the first stage sequentially to subsequent stages in synchronization with the data clock DCK, with the result that sampling pulses are outputted from the stages. Concurrently with the outputting of each sampling pulse, the sampling circuit is supplied with display data DA. The sampling circuit memorizes the display data DA in accordance with the sampling pulse. Once the sampling circuit memorizes the display data DA for one row, the display control circuit 20 outputs a latch pulse LP to the latch circuit. Upon reception of the latch pulse LP, the latch circuit holds the display data DA memorized in the sampling circuit. The D/A converters are provided corresponding to the m data lines $D_1$ to $D_m$ respectively connected to m output terminals (not shown) of the data driver 30, in order to supply the data lines $D_1$ to $D_m$ with data signals, which are analog signals converted from the display data DA held in the latch circuit by the D/A converters.

The scan driver 50 drives the n scanning lines $S_1$ to $S_n$. More specifically, the scan driver 50 includes unillustrated elements such as a shift register and a buffer. The shift register sequentially transfers gate start pulses SSP in synchronization with a gate clock SCK. Scanning signals, which are outputs from stages of the shift register, are sequentially supplied to corresponding current scanning lines $S_j$ (where j=1 to n) via the buffer. The m pixel circuits 11 connected to the current scanning line $S_j$ are collectively selected by an active scanning signal (in the present embodiment, a "low-level scanning signal"). Note that the scanning signal supplied to the current scanning line $S_j$ will also be referred to as the current scanning signal, and the scanning signal supplied to the preceding scanning line $S_{j-1}$ will also be referred to as the preceding scanning signal.

The emission driver 60 drives the n emission lines $E_1$ to $E_n$. More specifically, the emission driver 60 includes unillustrated elements such as a shift register and a buffer. The shift register sequentially transfers emission start pulses EMSP in synchronization with an emission clock EMCK. Emission signals, which are outputs from stages of the shift register, are supplied to corresponding emission lines $E_j$ via the buffer.

2.2 Method for Driving the Pixel Circuit

The configuration of the pixel circuit 11 in the organic EL display device 1 according to the present embodiment is the same as the configuration of the pixel circuit 11 described in the basic study and shown in FIG. 1, and therefore, any description thereof will be omitted.

Figure 4:
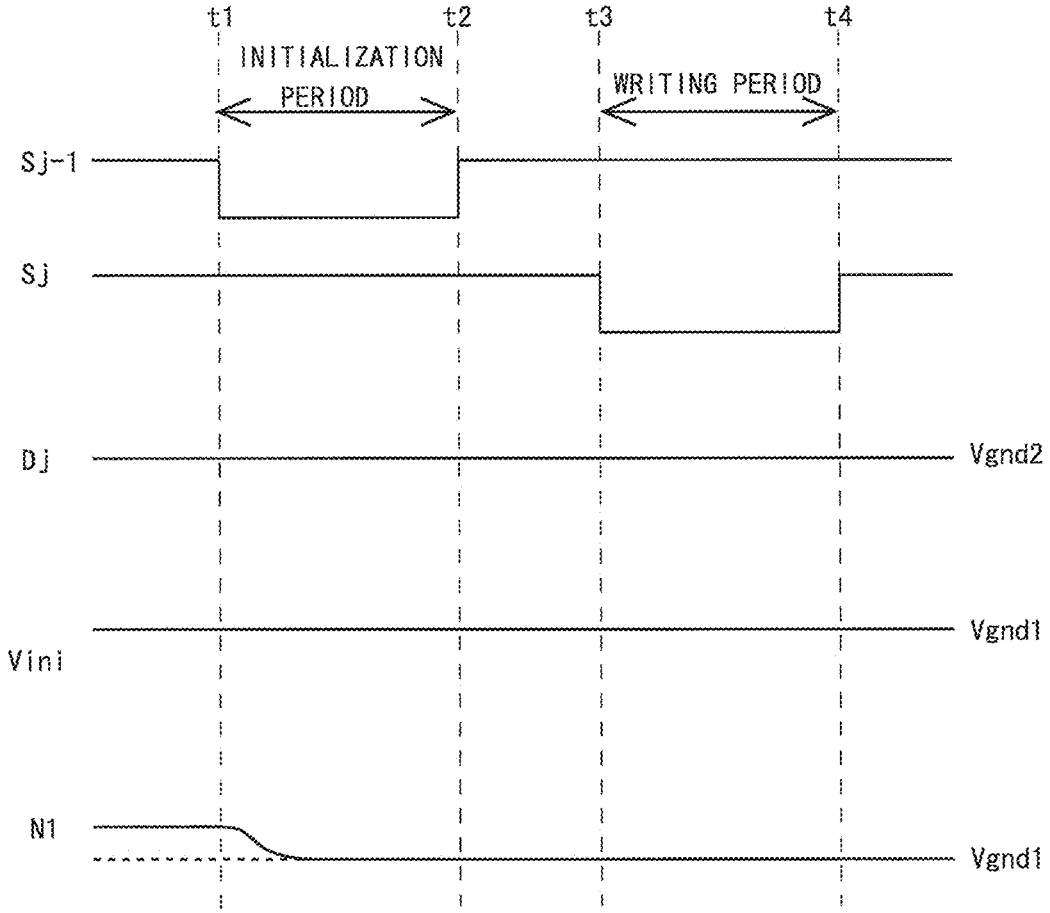
FIG. 4 is a timing chart describing a method for driving a pixel circuit of the organic EL display device according to the embodiment shown in FIG. 3 during an OFF sequence period.

FIG. 4 is a timing chart describing a method for driving the pixel circuit 11 of the organic EL display device 1 according to the present embodiment during an OFF sequence period. The OFF sequence period shown in FIG. 4 consists of an initialization period and a writing period provided following the initialization period, as in the timing chart shown in FIG. 2. Note that in the following description, the ground potential $V_{gnd}$ with which the initialization line $V_{ini}$ is charged will also be referred to as the first ground potential $V_{gnd1}$, and the ground potential $V_{gnd}$ with which the data line $D_j$ is charged will also be referred to as the second ground potential $V_{gnd2}$.

First, the initialization period will be described. At time t1, the preceding scanning line $S_{j-1}$ experiences a change in potential from the ground potential $V_{gnd}$ to low level. As a result, the gate terminal of the initialization transistor T4 is supplied with a low-level voltage, whereby the initialization transistor T4 is rendered in ON state. Moreover, at a time (not shown) when the organic EL display device is provided with a power-off command, the initialization line $V_{ini}$ experiences a change in potential from low level to the first ground potential $V_{gnd1}$, i.e., high level. As a result, unlike in the basic study, the first ground potential $V_{gnd1}$, which is a potential higher than the initialization potential $V_{ini}$, is supplied from the initialization line $V_{ini}$ to the first node N1 via the initialization transistor T4 in ON state.

At time t2, the preceding scanning line $S_{j-1}$ experiences a change in potential from low level to high level. Note that since the potential on the current scanning line $S_j$ is high-level, as in the basic study, the data compensation circuit 42 is not operated, and the data line $D_j$ is set at the second ground potential $V_{gnd2}$.

Next, the writing period will be described. At time t3, the current scanning line $S_j$ experiences a change in potential from high level to low level. Moreover, the data line $D_j$ is set at the second ground potential $V_{gnd2}$. Accordingly, the writing transistor T2 is rendered in ON state, and the second ground potential $V_{gnd2}$ is written from the data line $D_j$ to the second node N2 connected to both the source terminal, which is the second conductive terminal of the drive transistor T1, and the drain terminal, which is the second conductive terminal of the writing transistor T2. On the other hand, the first node N1 connected to the gate terminal of the drive transistor T1 is set at the first ground potential $V_{gnd1}$. Therefore, to keep the threshold voltage $V_{th}$ from being compensated for by the data compensation circuit 42, the following formula (1) needs to be established.

$$V_{gnd1}+V_{th}\geq V_{gnd2} \tag{1}$$

In the case where formula (1) is established, the first node N1 is not set to the gate-to-source voltage $V_{gs}$ represented by equation (2) below and remains at the first ground potential $V_{gnd1}$, whereby the drive transistor T1 remains in OFF state. Accordingly, the data compensation circuit 42 does not compensate for threshold voltage, and the first node N1 remains at the first ground potential $V_{gnd1}$.

$$V_{gs}=V_{gnd2}-V_{th} \tag{2}$$

Furthermore, at time t3, since the current scanning line $S_j$ is set to low level, the compensation transistor T3 has a low-level voltage at the gate terminal. Accordingly, the compensation transistor T3 is rendered in ON state. As a result, through the compensation transistor T3, the first ground potential $V_{gnd1}$ with which the first node N1 has been charged during the initialization period is supplied to the third node N3, which is a connecting point between the first conductive terminal of the drive transistor T1 and the first conductive terminal of the compensation transistor T3, with the result that the third node N3 is set to the first ground potential $V_{gnd1}$ as well. In this manner, the first node N1 and the third node N3 in the pixel circuit 11 are set at the first ground potential $V_{gnd1}$, and the second node N2 is set at the second ground potential $V_{gnd2}$, whereby the organic EL display device 1 will not be powered off with any electric charge remaining in the pixel circuit 11. Thus, no electric charge remains in the pixel circuit, whereby the transistors included in the pixel circuit 11 are kept from deteriorating and no afterimage appears when the display part 10 displays another image by turning power back on after power off.

Figure 5:
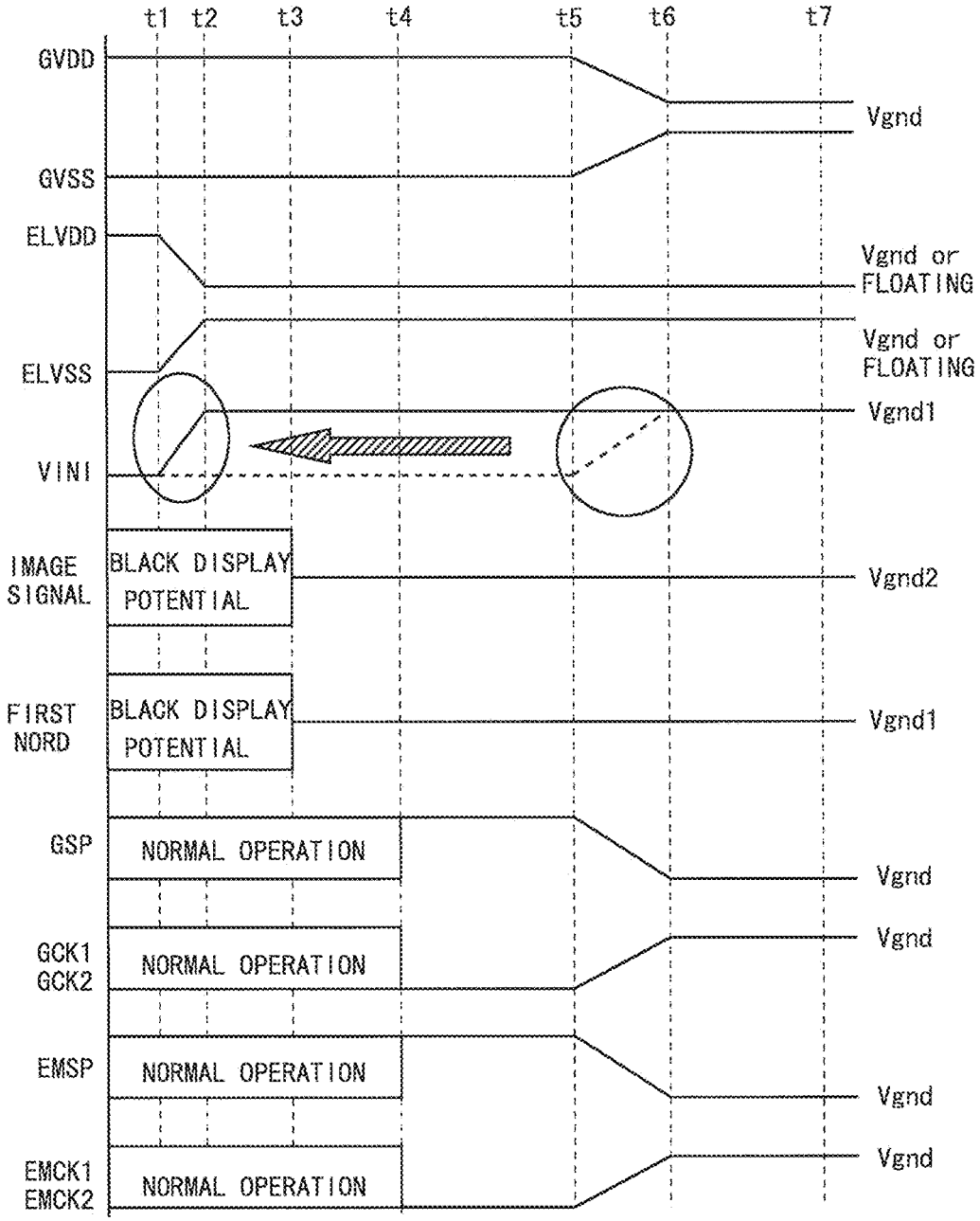
FIG. 5 is a timing chart describing the operation of the organic EL display device shown in FIG. 3 during the OFF sequence period.

FIG. 5 is a timing chart describing the operation of the organic EL display device 1 during the OFF sequence period. The operation of the organic EL display device 1 during the OFF sequence period will be described with reference to FIG. 5. At time t0, the organic EL display device 1 is powered off, and the OFF sequence period starts. As has already been described, the OFF sequence period is divided into the initialization period from time t0 to time t3 and the writing period from time t3 to time t5.

Once the organic EL display device 1 is powered off and the OFF sequence period starts at time t0, the potential of an image signal is switched to a black display potential. As a result, the black display potential is applied to charge the first node N1 through the data line $D_j$, the writing transistor T2, the drive transistor T1, and the compensation transistor T3, whereby the first node N1 is set at the black display potential as well. During the initialization period from time t0 to time t3 and the writing period from time t3 to time t5, a high-level power line of the organic EL display device 1 maintains a high-level potential ELVDD, and a low-level power line ELVSS maintains a low-level potential ELVSS.

During the period from time t1 to time t2, the high-level power line ELVDD, which supplies a power supply potential to the organic EL element OLED of each pixel circuit 11, experiences a change in potential from the high-level potential ELVDD to the ground potential $V_{gnd}$ or floating state, and the low-level power line ELVSS experiences a change in potential from the low-level potential ELVSS to the ground potential $V_{gnd}$ or floating state. Concurrently with this, the initialization potential $V_{ini}$ on the initialization line $V_{ini}$ is changed from low level to the first ground potential $V_{gnd1}$.

During the period from time t2 to time t3, the data driver 30 provides the data line $D_j$ with a black display potential, which corresponds to a black display data signal for causing the display part 10 to display an entirely black screen, with the result that the data line $D_j$ is charged with the black display potential, which is written to the first node N1 via the writing transistor T2, the drive transistor T1, and the compensation transistor T3. Moreover, at time t2, the initialization potential $V_{ini}$ is set to the first ground potential $V_{gnd1}$. At time t3, the potential of the black display data signal changes to the second ground potential $V_{gnd2}$, thereby keeping the gate-to-source voltage $V_{gs}$ from being written to the gate terminal of the drive transistor T1, with the result that the gate terminal remains at the first ground potential $V_{gnd1}$, and the drive transistor T1 is rendered in OFF state. In this manner, the drive transistor T1 is rendered in OFF state by changing the initialization potential $V_{ini}$ from low level to the first ground potential $V_{gnd1}$, i.e., high level, at the time when the high-level potential ELVDD and the low-level potential ELVSS are changed to the ground potential $V_{gnd}$ or floating state. In the foregoing, the initialization potential $V_{ini}$ on the initialization line $V_{ini}$ is changed from low level to the first ground potential $V_{gnd1}$ during the period from time t1 to time t2, but this is not limiting, and such a change may occur during any period, for example, the period from time t0 to time t1 or from time t2 to time t3, so long as the image signal is set at the black display potential during that period.

It should be noted that the gate start pulse SSP and the gate clock SCK intended for driving the scan driver 50 and the emission start pulse EMSP and the emission clock EMCK intended for driving the emission driver 60 continue to be outputted until time t4, and therefore, the data driver 30, the scan driver 50, and the emission driver 60 are operated until time t4.

Next, the operation of the organic EL display device 1 during the period from time t5 to time t7 will be described. During the period from time t5 to time t6, each of the high-level potential GVDD from the high-level power supply of the organic EL display device 1 and the low-level potential GVSS from the low-level power is changed to the ground potential $V_{gnd}$. Moreover, during the period from time t5 to time t6, each of the gate start pulse SSP, the gate clock SCK, the emission start pulse EMSP, and the emission clock EMCK is changed from high or low level to the ground potential $V_{gnd}$.

In the basic study, the initialization potential $V_{ini}$ on the initialization line $V_{ini}$ is changed from low level to the first ground potential $V_{gnd1}$ during the period from time t5 to time t6. However, in the present embodiment, as has already been described, the initialization potential $V_{ini}$ is changed from low level to high level during the period from time t1 to time t2 within the initialization period. Accordingly, in the present embodiment, the first ground potential $V_{gnd1}$ with which the first node N1 has been charged during the initialization period keeps the drive transistor T1 in OFF state, and therefore, no electric charge remains in the pixel circuit 11.

2.3 Effects

In the present embodiment, during the OFF sequence period, the first node N1 is set to the first ground potential $V_{gnd1}$, which is a potential higher than the initialization potential $V_{ini}$. As a result, even when the second ground potential $V_{gnd2}$ is supplied from the data line $D_j$ to the second conductive terminal of the drive transistor T1, the gate terminal of the drive transistor T1 is not charged with the gate-to-source voltage $V_{gs}$. Therefore, the organic EL display device 1 is powered off with the gate terminal of the drive transistor T1 being charged with the first ground potential $V_{gnd1}$. Thus, no electric charge remains in the pixel circuit 11 after the power off, whereby the transistors included in the pixel circuit 11 are kept from deteriorating and no afterimage appears when the display part 10 displays another image by turning the power back on after the power off.

2.4 Variant

In the embodiment, all of the six transistors included in the pixel circuit 11 are of P-channel type, but the transistors may be of N-channel type. Accordingly, the present variant will be described with respect to the case where all of the six transistors included in the pixel circuit are of N-channel type. In this case, the general configuration of the organic EL display device is the same as in the embodiment, and the pixel circuit is the same as the pixel circuit 11 shown in FIG. 2, except that all of the six transistors T1 to T6 included therein are of N-channel type. Therefore, any figures illustrating the general configuration of the organic EL display device and the configuration of the pixel circuit 11, along with any descriptions thereof, will be omitted.

Figure 6:
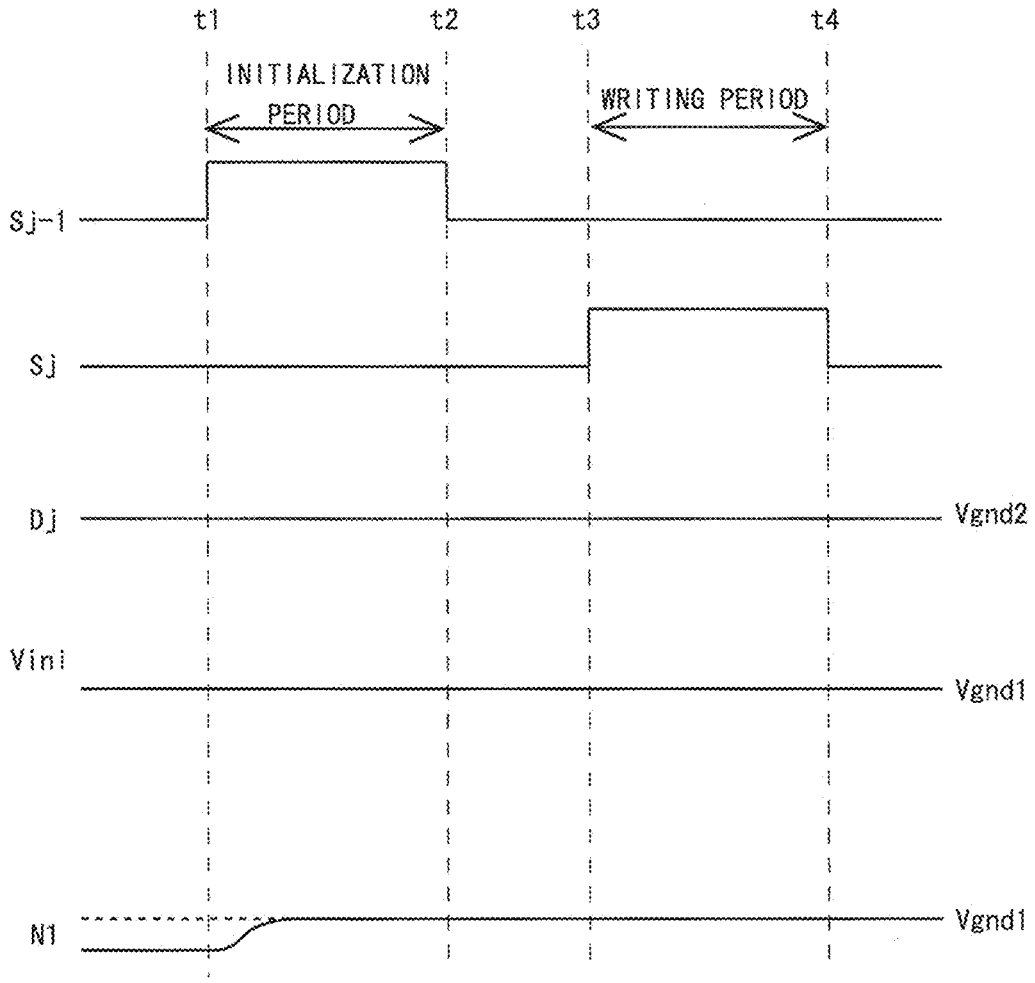
FIG. 6 is a timing chart describing a method for driving a pixel circuit of an organic EL display device according to a variant of the first embodiment during an OFF sequence period.

FIG. 6 is a timing chart describing a method for driving the pixel circuit of the organic EL display device according to the present variant during an OFF sequence period. The OFF sequence period shown in FIG. 6 consists of an initialization period and a writing period provided following the initialization period, as in the timing chart shown in FIG. 4.

First, the initialization period will be described. At time t1, the preceding scanning line $S_{j-1}$ experiences a change in potential from low level to high level. As a result, the gate terminal of the initialization transistor T4 is supplied with a high-level voltage, whereby the initialization transistor T4 is rendered in ON state. Moreover, at a time (not shown) when the organic EL display device is provided with a power-off command, the initialization line $V_{ini}$ experiences a change in potential from high level to the first ground potential $V_{gnd1}$, i.e., low level. As a result, the first ground potential $V_{gnd1}$ from the initialization line $V_{ini}$ is written to the first node N1 via the initialization transistor T4 in ON state. At time t2, the preceding scanning line $S_{j-1}$ experiences a change in potential from high level to low level. In this manner, during the initialization period, the initialization circuit 41 is operated, thereby charging the first node N1 with the first ground potential $V_{gnd1}$. Note that since the current scanning line $S_j$ is at low level, the data compensation circuit 42 is not operated, and the data line $D_j$ is set at the second ground potential $V_{gnd2}$.

Next, the writing period will be described. At time t3, the current scanning line $S_j$ experiences a change in potential from low level to high level. Moreover, the data line $D_j$ is at the second ground potential $V_{gnd2}$. Accordingly, the writing transistor T2 is rendered in ON state, and the second ground potential $V_{gnd2}$ from the data line $D_j$ is written to the second node N2 connected to the second conductive terminal of the drive transistor T1 and the second conductive terminal of the writing transistor T2.

On the other hand, the first node N1 connected to the gate terminal of the drive transistor T1 is at the first ground potential $V_{gnd1}$. Therefore, to keep any changes of the threshold voltage $V_{th}$ from being compensated for by the data compensation circuit 42, the following formula (3) needs to be established, given the drive transistor T1 is of N-channel type.

$$V_{gnd1}-V_{th}\leq V_{gnd2} \tag{3}$$

In the case where formula (3) is established, the first node N1 is not set to the gate-to-source voltage $V_{gs}$ represented by formula (4) below and remains at the first ground potential $V_{gnd1}$, with the result that the drive transistor T1 remains in OFF state. Accordingly, the data compensation circuit 42 does not compensate for any changes of the threshold voltage $V_{th}$, and the first node N1 remains at the first ground potential $V_{gnd1}$.

$$V_{gs}=V_{gnd2}+V_{th} \tag{4}$$

Furthermore, at time t3, the current scanning line $S_j$ experiences a change from low level to high level, and therefore, the compensation transistor T3 has also a high-level voltage at the gate terminal. Accordingly, the compensation transistor T3 is rendered in ON state. As a result, the first ground potential $V_{gnd1}$ with which the first node N1 has been charged during the initialization period is supplied to the third node N3, which is a connecting point between the first conductive terminal of the drive transistor T1 and the first conductive terminal of the compensation transistor T3, via the compensation transistor T3, with the result that the third node N3 is set to the first ground potential $V_{gnd1}$ as well. In this manner, each of the first node N1 and the third node N3 in the pixel circuit 11 is set to the first ground potential $V_{gnd1}$, and the second node N2 is set to the second ground potential $V_{gnd2}$, whereby the organic EL display device 1 will not be powered off with any electric charge remaining in the pixel circuit 11. Thus, no electric charge remains in the pixel circuit after the organic EL display device is powered off, whereby the transistors included in the pixel circuit 11 are kept from deteriorating, and no afterimage appears when the display part 10 displays another image by turning the power back on after the power off.

3. Second Embodiment

Figure 7:
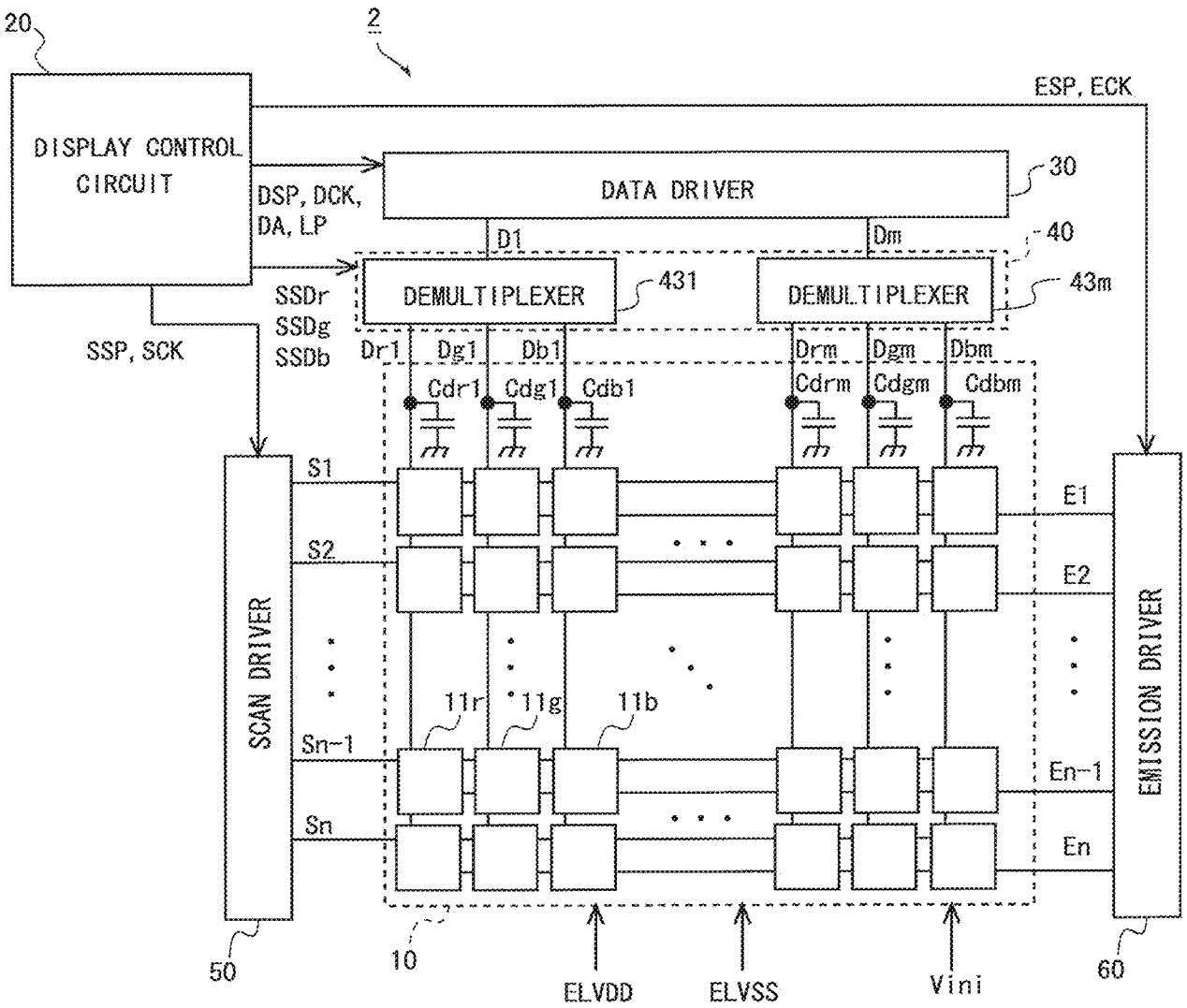
FIG. 7 is a block diagram illustrating the general configuration of an organic EL display device according to a second embodiment of the present invention.

FIG. 7 is a block diagram illustrating the general configuration of an organic EL display device 2 according to a second embodiment of the present invention. The organic EL display device 2 is an active-matrix display device capable of color display in the three primary colors, R, G, and B. The organic EL display device 2 shown in FIG. 7 is a display device which includes a display part 10, a display control circuit 20, a data driver 30, a demultiplexing part 40, a scan driver 50, and an emission driver 60, and employs an SSD (source shared driving) method in which the data driver 30 supplies data signals to data lines $D_{r1}$ to $D_{rm}$, $D_{g1}$ $D_{gm}$, and $D_{b1}$ to $D_{bm}$ via the demultiplexing part 40.

The display part 10 has m data lines $D_1$ to $D_m$ disposed along with n scanning lines $S_1$ to $S_n$, and n emission lines $E_1$ to $E_n$. The demultiplexing part 40 includes m demultiplexers (also referred to as "select/output circuits") $\mathbf{43}_1$ to $\mathbf{43}_m$, which are respectively connected to the m data lines $D_1$ to $D_m$. Note that since the display part 10, the display control circuit 20, the data driver 30, the scan driver 50, and the emission driver 60 are configured in the same manner as in FIG. 3, any descriptions thereof will be omitted, and the demultiplexing part 40 will simply be described below.

3.1 Configuration of the Demultiplexing Part

Figure 8:
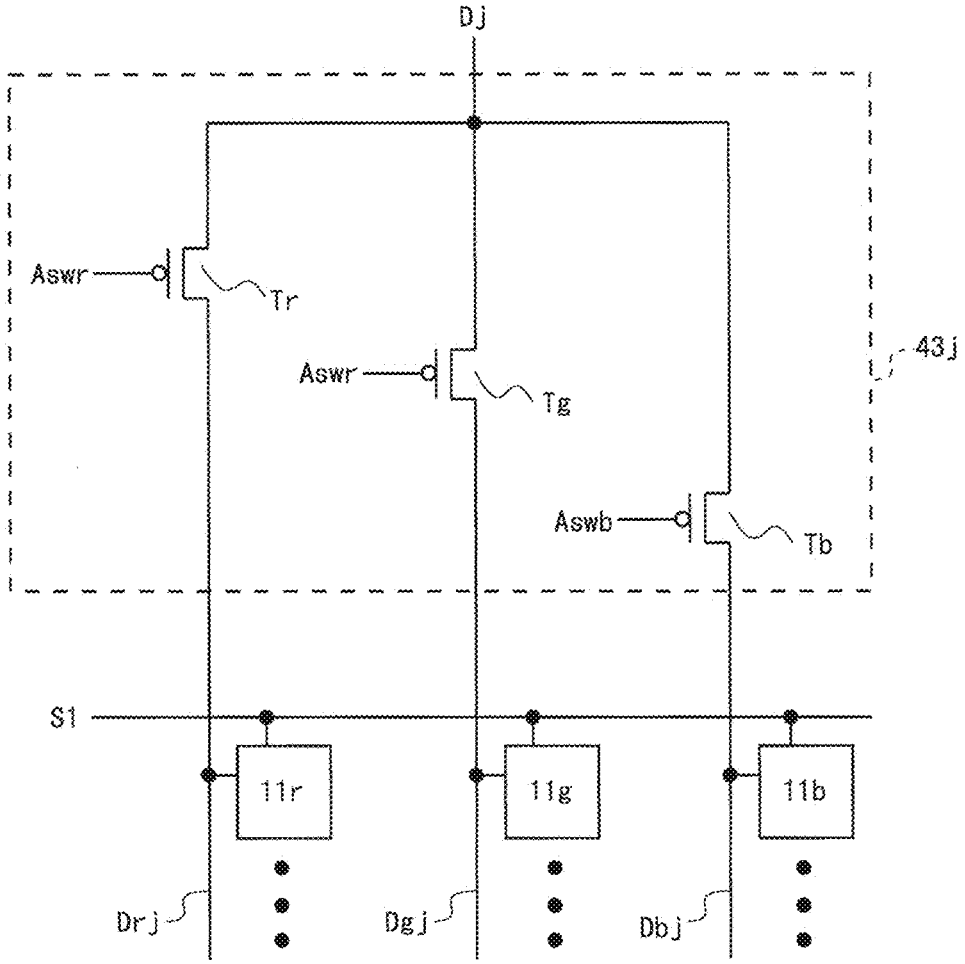
FIG. 8 is a circuit diagram illustrating the configuration of a demultiplexer included in a demultiplexing part of the organic EL display device shown in FIG. 7.

FIG. 8 is a circuit diagram illustrating the configuration of a demultiplexer $\mathbf{43}_j$ included in the demultiplexing part 40 shown in FIG. 7. The configuration of the demultiplexer $\mathbf{43}_j$ will be described with reference to FIG. 8. Each demultiplexer $\mathbf{43}_j$ includes three selection transistors $T_r$, $T_g$, and $T_b$. All of the selection transistors $T_r$, $T_g$, and $T_b$ will be described as being P-channel transistors, but may be N-channel transistors.

The selection transistors $T_r$, $T_g$, and $T_b$ included in the demultiplexer $\mathbf{43}_j$ respectively select an R data signal $R_j$, a G data signal $G_j$, and a B data signal $B_j$. When a gate terminal of the selection transistor $T_r$ is provided with a selection control signal $ASW_r$ from the display control circuit 20 simultaneously with an R data signal $R_j$ being provided through the data line $D_j$, the selection transistor $T_r$ is rendered in ON state and supplies the R data signal $R_j$ to the R data line $D_{rj}$. When a gate terminal of the selection transistor $T_g$ is provided with a selection control signal $ASW_g$ from the display control circuit 20 simultaneously with a G data signal $G_j$ being provided through the data line $D_j$, the selection transistor $T_g$ supplies the G data signal $G_j$ to the G data line $D_{gj}$. When a gate terminal of the selection transistor $T_b$ is provided with a selection control signal $ASW_b$ from the display control circuit 20 simultaneously with a B data signal $B_j$ being provided through the data line $D_j$, the selection transistor $T_b$ supplies the B data signal B to the B data line $D_{bj}$.

Similarly, for each horizontal period, the other demultiplexers supply R data signals to R data lines, G data signals to G data lines, and B data signals to B data lines. In this manner, by using the demultiplexers $\mathbf{43}_1$ to $\mathbf{43}_m$, it is rendered possible to reduce the number of output terminals of the data driver 30, thereby reducing the cost of producing the data driver 30. Note that the number of selection transistors included in the demultiplexer $\mathbf{43}_j$ in FIG. 8 is three, but the number is not specifically limited so long as the number falls within the range from two to m.

The R data line $D_j$ is connected to n R subpixel circuits $\mathbf{11}_r$, and R data signals sequentially supplied through the R data line $D_{rj}$ are sequentially written to the n R subpixel circuits $\mathbf{11}_r$. The G data line $D_{gj}$ is connected to n G subpixel circuits $\mathbf{11}_g$, and G data signals sequentially supplied through the G data line $D_{gj}$ are sequentially written to the n G subpixel circuits $\mathbf{11}_g$. The B data line Db is connected to n B subpixel circuits $\mathbf{11}_b$, and B data signals sequentially supplied through the B data line $Db_j$ are sequentially written to the n B subpixel circuits $\mathbf{11}_b$.

3.2 Drive Method

Figure 9:
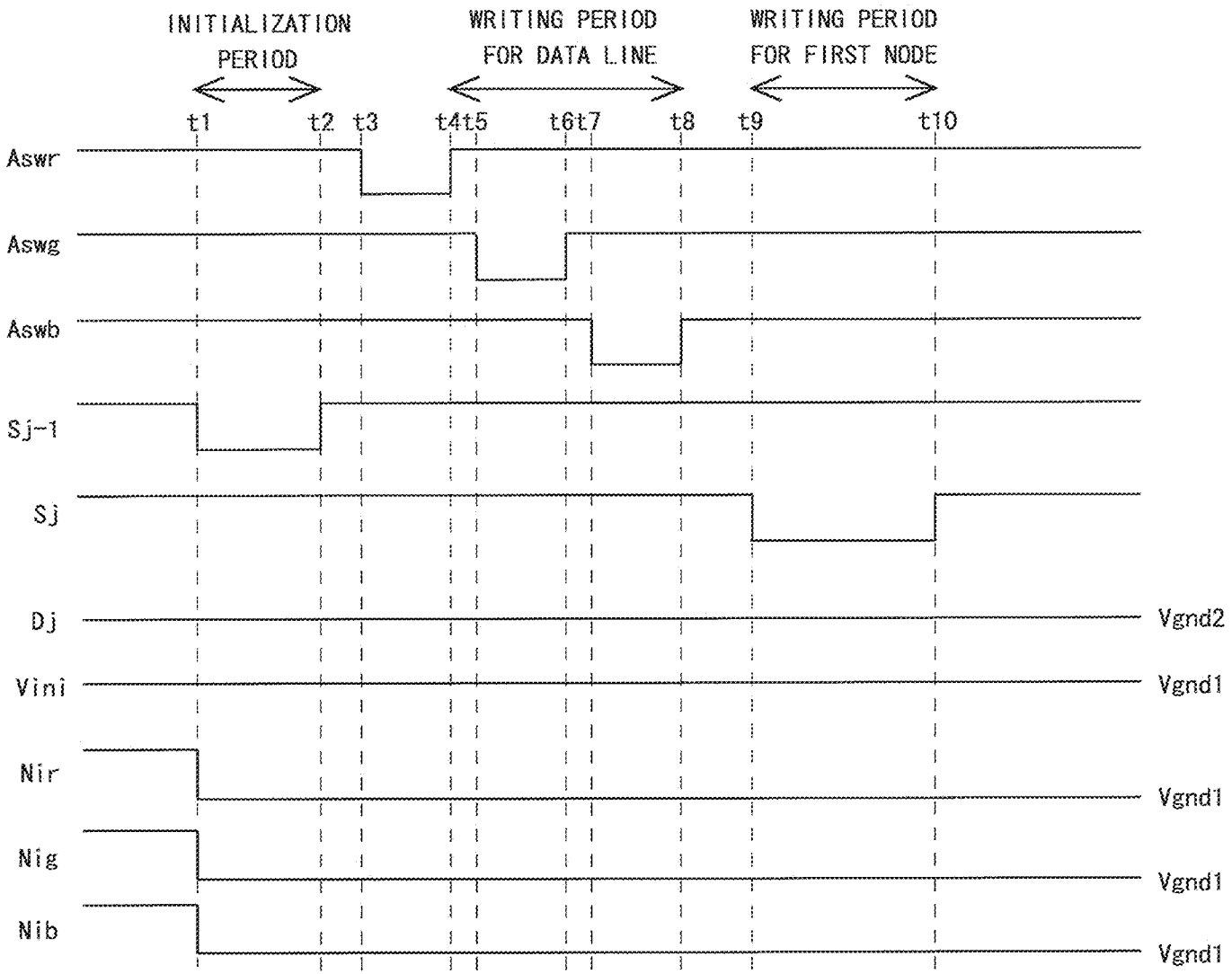
FIG. 9 is a timing chart describing a method for driving subpixel circuits of the organic EL display device shown in FIG. 7 during an OFF sequence period.

FIG. 9 is a timing chart describing a method for driving the subpixel circuits $\mathbf{11}_r$, $\mathbf{11}_g$, and $\mathbf{11}_b$ of the organic EL display device 2 in the present embodiment during an OFF sequence period. As shown in FIG. 9, at time t1, the preceding scanning line $S_{j-1}$ experiences a change in potential from high level to low level. As a result, the gate terminal of the initialization transistor T4 in each of the subpixel circuits $\mathbf{11}_r$, $\mathbf{11}_g$, and $\mathbf{11}_b$ is supplied with a low-level voltage, whereby the initialization transistor T4 is rendered in ON state. Moreover, at a time (not shown) when the organic EL display device 2 is provided with a power-off command, the initialization line $V_{ini}$ experiences a change in potential from low level to the first ground potential $V_{gnd1}$. As a result, the first ground potential $V_{gnd1}$ from the initialization line $V_{ini}$ is applied to charge the first node N1 in each of the subpixel circuits $\mathbf{11}_r$, $\mathbf{11}_g$, and $\mathbf{11}_b$ via the initialization transistor T4 in ON state. At time t2, the preceding scanning line $S_{j-1}$ experiences a change in potential from low level to high level. In this case, since the current scanning line $S_j$ is at high level, the compensation transistor T3 is in OFF state, and the data line $D_j$ is at the second ground potential $V_{gnd2}$.

During the period from time t3 to time t4, simultaneously with an R data signal $R_j$ being supplied to the data line $D_j$, a data control signal $Asw_r$ experiences a change in potential from high level to low level, thereby rendering the selection transistor $T_r$ in ON state. As a result, the selection transistor $T_r$ selects and writes the R data signal $R_j$ to the data line $D_{rj}$. During the period from time t5 to time t6, simultaneously with a G data signal $G_j$ being supplied to the data line $D_j$, a data control signal $Asw_g$ experiences a change in potential from high level to low level, thereby rendering the selection transistor $T_g$ in ON state. As a result, the selection transistor $T_g$ selects and writes the G data signal $G_j$ to the data line $D_{gj}$. During the period from time t7 to time t8, simultaneously with a B data signal $B_j$ being supplied to the data line $D_j$, a data control signal $Asw_b$ experiences a change in potential from low level to high level, thereby rendering the selection transistor $T_b$ in ON state. As a result, the selection transistor $T_b$ selects and writes the B data signal $B_j$ to the data line $D_{bj}$. In this manner, the data signals $R_j$, $G_j$, and $B_j$ are respectively written to the data lines $D_{rj}$, $D_{gj}$, and $D_{bj}$.

During the period from time t9 to time t10, the current scanning line $S_j$ experiences a change in potential from high level to low level, thereby rendering the writing transistor T2 in each of the subpixel circuits $\mathbf{11}_r$, $\mathbf{11}_g$, and $\mathbf{11}_b$ in ON state. As a result, the second ground potential $V_{gnd2}$ as below is simultaneously written to the second node N2 in each of the subpixel circuits $\mathbf{11}_r$, $\mathbf{11}_g$, and $\mathbf{11}_b$. More specifically, the second ground potential $V_{gnd2}$ written to the R data line $D_{rj}$ during the period from time t3 to time t4 is written to the second node N2 of the R subpixel circuit $\mathbf{11}_r$, the second ground potential $V_{gnd2}$ written to the G data line $D_{gj}$ during the period from time t5 to time t6 is written to the second node N2 of the G subpixel circuit $\mathbf{11}_g$, and the second ground potential $V_{gnd2}$ written to the B data line $D_{bj}$ during the period from time t7 to time t8 is written to the second node N2 of the B subpixel circuit $\mathbf{11}_b$.

Furthermore, at time t9, since the current scanning line $S_j$ is set to low level, the compensation transistor T3 has a low-level voltage at the gate terminal. Accordingly, the compensation transistor T3 in each of the subpixel circuits $\mathbf{11}_r$, $\mathbf{11}_g$, and $\mathbf{11}_b$ is rendered in ON state. As a result, the first ground potential $V_{gnd1}$ with which the first node N1 of each of the subpixel circuits $\mathbf{11}_r$, $\mathbf{11}_g$, and $\mathbf{11}_b$ has been charged during the initialization period is supplied to the third node N3, which is a connecting point between the first conductive terminal of the drive transistor T1 and the first conductive terminal of the compensation transistor T3, via the compensation transistor T3. Consequently, the third node N3 of each of the subpixel circuits $\mathbf{11}_r$, $\mathbf{11}_g$, and $\mathbf{11}_b$ is set to the first ground potential $V_{gnd1}$.

3.3 Effects

In the present embodiment, since the first node N1 and the third node N3 in each of the subpixel circuits $\mathbf{11}_r$, $\mathbf{11}_g$, and $\mathbf{11}_b$ are set at the first ground potential $V_{gnd1}$, and the second node N2 is set at the second ground potential $V_{gnd2}$, the organic EL display device 1 is not powered off with any electric charge remaining in the subpixel circuits 11r, $\mathbf{11}_g$, and $\mathbf{11}_b$. Thus, since no electric charge remains in the pixel circuit when the organic EL display device is powered off, the transistors included in the pixel circuit 11 are kept from deteriorating, and no afterimage appears when the display part 10 displays another image by turning the power back on after the power off.

4. Other

The displays described herein are not limited to display panels with organic EL elements OLED, and may be display panels with electro-optical elements whose luminance and/or transmittance are controlled by current. Examples of displays with such current-controlled electro-optical elements include EL displays, such as organic EL displays with organic light-emitting diodes (OLEDs) and inorganic EL displays with inorganic light-emitting diodes, and QLED displays with quantum-dot light-emitting diodes.

DESCRIPTION OF THE REFERENCE CHARACTERS

1 display device
10 display part
11 pixel circuit
$\mathbf{11}_r$, $\mathbf{11}_g$, $\mathbf{11}_b$ subpixel circuit
15 first power supply
16 second power supply
20 display control circuit
30 data driver (data line driver circuit)
40 demultiplexing part
50 scan driver (scanning line driver circuit)
60 emission driver (control line driver circuit)
$D_j$ output line
$S_j$ scanning line
$E_j$ emission line (control line)
T1 to T6 transistor
C capacitor (capacitive element)
ELVDD high-level power line
ELVSS low-level power line
$V_{ini}$ initialization line

The invention claimed is:

1. A method for driving an active-matrix display device for displaying an image by causing electro-optical elements to emit light, wherein, the display device includes:

a plurality of data lines supplied with data signals to display the image;

a plurality of scanning lines crossing the plurality of data lines;

a plurality of pixel circuits provided at intersections of the plurality of data lines and the plurality of scanning lines;

a data line driver circuit configured to supply the data signals respectively to the plurality of data lines; and a scanning line driver circuit configured to sequentially select and thereby activate the plurality of scanning lines one by one at times when the data signals are supplied to the plurality of data lines, each of the plurality of pixel circuits include:

an electro-optical element;

a drive transistor configured to control a current flowing in the electro-optical element and having a control terminal and a first conductive terminal electrically connected when a corresponding scanning line of the plurality of scanning lines that is connected to the each of the plurality of pixel circuits is activated;

a first node connected to the control terminal;

a second node connected to a second conductive terminal of the drive transistor;

a data compensation circuit configured to compensate for changes of a threshold voltage of the drive transistor and hold a potential on the first node; and an initialization circuit configured to initialize an initial potential on the first node, and an OFF sequence involved in powering off the display device includes:

an initialization step that writes a first ground potential to the first node during a period after a power off, in which a black display potential corresponding to black display data is supplied to the plurality of data lines, the first ground potential having an absolute value larger than the initial potential initializing the potential on the first node; and a writing step, when the corresponding scanning line connected to a corresponding pixel circuit is activated, that writes a second ground potential, which does not render the drive transistor conductive, to the second node through a corresponding data line of the plurality of data lines to not electrically connect the control terminal and the first conductive terminal.

2. The method according to claim 1, wherein, transistors included in the plurality of pixel circuits are P-channel transistors, and the second ground potential is less than or equal to a potential obtained by adding the threshold voltage of the drive transistor to the first ground potential.

3. The method according to claim 1, wherein, transistors included in the plurality of pixel circuits are N-channel transistors, and the second ground potential is greater than or equal to a potential obtained by subtracting the threshold voltage of the drive transistor from the first ground potential.

4. The method according to claim 1, wherein, the initialization circuit includes an initialization line for supplying the first ground potential and an initialization transistor configured to electrically connect the initialization line and the first node, and the initialization step includes:

supplying the first ground potential to the initialization line after the power off;

rendering the initialization transistor conductive in accordance with an active preceding scanning signal outputted by the scanning line driver circuit; and writing the first ground potential from the initialization line to the first node via the initialization transistor.

5. The method according to claim 1, wherein, the display device further includes a power supply configured to supply a power supply voltage to the electro-optical element, and in the initialization step, the first ground potential is written to the first node at a time when the power supply voltage is stopped from being supplied to the electro-optical element.

6. The method according to claim 1, wherein, each of the plurality of pixel circuits further includes a writing transistor configured to electrically connect a corresponding data line of the plurality of data lines and the second node, and the writing step includes:

supplying the second ground potential to the corresponding data line;

rendering the writing transistor conductive in accordance with a current scanning signal activating the corresponding scanning line; and writing the second ground potential supplied to the corresponding data line to the second node.

7. The method according to claim 6, wherein, the data compensation circuit includes:

a compensation transistor configured to electrically connect the first conductive terminal and the control terminal of the drive transistor in accordance with a scanning signal provided by the scanning line driver circuit; and a capacitive element configured to hold a voltage between the first conductive terminal and the control terminal, each of the plurality of pixel circuits further includes a third node connected to the first conductive terminal of the drive transistor, and the writing step further includes:

rendering the compensation transistor conductive in accordance with a current scanning signal; and writing the second ground potential written to the first node to the third node via the conductive compensation transistor.

8. The method according to claim 1, wherein, the display device further includes a plurality of select/output circuits configured to select color data signals from among a plurality of color data signals to display color images and supply the selected color data signals respectively to the plurality of data lines, the plurality of color data signals being included in data signals that are supplied from the data line driver circuit and correspond to a plurality of primary colors, each of the plurality of pixel circuits further includes a plurality of subpixel circuits configured to cause the electro-optical elements to emit light in accordance with the plurality of color data signals, the initialization step includes simultaneously writing the first ground potential supplied through an initialization line to the first nodes of the plurality of subpixel circuits, the writing step includes:

writing the second ground potential sequentially to the plurality of data lines, the second ground potential corresponding to each of the primary colors selected by the plurality of select/output circuits; and rendering a writing transistor conductive in accordance with a current scanning signal outputted by the scanning line driver circuit, thereby writing the second ground potential simultaneously to the second nodes of the plurality of subpixel circuits through the plurality of data lines.

9. An active-matrix display device that displays an image by causing electro-optical elements to emit light, the display device comprising:

a plurality of data lines supplied with data signals to display the image;

a plurality of scanning lines crossing the plurality of data lines;

a plurality of pixel circuits provided at intersections of the plurality of data lines and the plurality of scanning lines;

a data line driver circuit configured to supply the data signals respectively to the plurality of data lines; and a scanning line driver circuit configured to sequentially select and thereby activate the plurality of scanning lines one by one at times when the data signals are supplied to the plurality of data lines, each of the plurality of pixel circuits include:

an electro-optical element;

a drive transistor configured to control a current flowing in the electro-optical element and having a control terminal and a first conductive terminal electrically connected when a corresponding scanning line of the plurality of scanning lines that is connected to the each of the plurality of pixel circuits is active;

a first node connected to the control terminal;

a second node connected to a second conductive terminal of the drive transistor;

a data compensation circuit configured to compensate for changes of a threshold voltage of the drive transistor and hold a potential on the first node; and an initialization circuit configured to initialize an initial potential on the first node, when the display device is powered off, the initialization circuit writes a first ground potential to the first node during a period in which a black display potential corresponding to black display data is supplied to the plurality of data lines, the first ground potential having an absolute value larger than the initial potential initializing the potential on the first node, and when the corresponding scanning line is activated, the data compensation circuit writes a second ground potential, which does not render the drive transistor conductive, to the second node through a corresponding data line of the plurality of data lines to not electrically connect the control terminal and the first conductive terminal.

* * * * *